United States Patent [19]

Di Vita

[11] Patent Number: 4,764,022

[45] Date of Patent: Aug. 16, 1988

[54] KNEADER FOR PAPER PRODUCTS AND/OR SIMILAR WASTE PRODUCTS

[75] Inventor: Angelo Di Vita, Buccinasco, Italy

[73] Assignees: I.C.A. S.p.A., Pesaro; A. Celli S.p.A., Lucca, both of Italy

[21] Appl. No.: 817,887

[22] Filed: Jan. 10, 1986

[30] Foreign Application Priority Data

Jan. 14, 1985 [IT] Italy ..... 20484/85[U]

[51] Int. Cl.[4] ..... B01F 7/16; B01F 7/24; B01F 15/02

[52] U.S. Cl. ..... 366/157; 241/46.02; 241/46.17; 366/294; 366/295; 366/306; 366/314; 366/323

[58] Field of Search ..... 366/157, 287, 294, 295, 366/302, 306, 323, 331, 314, 244, 261; 241/21, 46.02, 46.17, 101.2, 199.12, 244, 257 B; 162/57, 261

[56] References Cited

U.S. PATENT DOCUMENTS

| | | | |
|---|---|---|---|
| 2,641,971 | 6/1953 | Ellis | 366/325 X |
| 3,198,493 | 8/1965 | Sukup | 366/261 |
| 3,682,447 | 8/1972 | Zucker et al. | 366/157 |
| 3,722,832 | 3/1973 | Seifert | 366/325 |
| 3,746,314 | 7/1973 | Nauta | 366/294 X |
| 4,552,462 | 11/1985 | Schnell | 366/287 X |

FOREIGN PATENT DOCUMENTS

| | | | |
|---|---|---|---|
| 2124313 | 11/1972 | Fed. Rep. of Germany | 366/287 |
| 644539 | 1/1979 | U.S.S.R. | 366/287 |
| 1151288 | 4/1985 | U.S.S.R. | 366/287 |

*Primary Examiner*—Harvey C. Hornsby
*Assistant Examiner*—Scott J. Haugland
*Attorney, Agent, or Firm*—Hopgood, Calimafde, Kalil, Blaustein & Judlowe

[57] ABSTRACT

A kneader for paper products and/or similar waste products, comprising a tank provided with an impeller on the bottom, and also provided with a helix or propeller element, which is not coupled with said impeller and is apt to feed the worked product to the same impeller, said helix or propeller element being substantially disposed in an axial relation to said impeller.

2 Claims, 1 Drawing Sheet

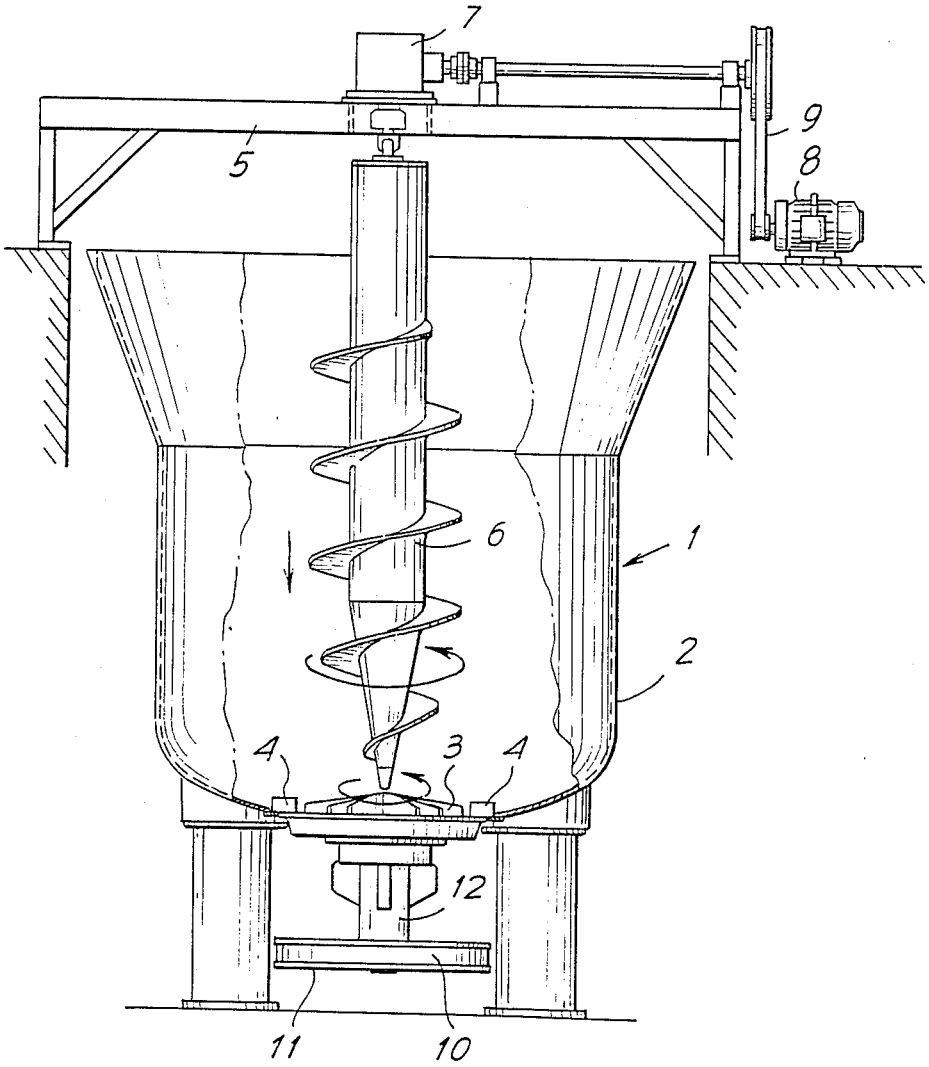
7
9
5
8
6
1
2
4
3
4
12
11
10

KNEADER FOR PAPER PRODUCTS AND/OR SIMILAR WASTE PRODUCTS

DESCRIPTION

The present invention refers to a kneader for paper products and/or similar waste or recovery products, with a combination and conformation of parts giving same kneader distinctive utility characteristics.

Kneaders of the indicated type have been known for a long time being designed and studied for the kneading of high density products and made up of a static, that is fixed, tank provided on the bottom with an impeller directly associated, that is solid, with a helix or propeller element, said element being intended to give rise to a vortex for the transfer of the worked mass towards the same impeller.

Such conventional solution presents several drawbacks, among which, and not only, the need to limit the level of the water and possible additives just as much as to cover the top of the propeller element. The coupling of the propeller element with the impeller, involves the necessity of utilizing considerable powers and, however, such as to be not compatible with the consumption requirements in relation to the final treated product.

Another drawback present in the conventional kneaders of the above mentioned type consists in that the transfer of the mass being treated towards the impeller is such as to create a zone—in the close vicinity of the latter—in which a vacuum is generated with consequent less efficiency of same impeller.

It can be also pointed out that the combined arrangement between the impeller and the helix or propeller element permits to convey the worked mass only in the vicinty of the end of blades of same impeller, that, obviously, further reduces the efficiency of the latter.

In addition to the above mentioned drawbacks, the conventional kneaders give a rather low efficiency and, anyway, they work with densities below 20%.

The object of the invention is to provide a kneader which overcomes the above drawbacks and, in particular, allows the working with product densities higher than 20% with a substantially reduced energy consumption in relation to the efficiency.

This and other objects of the invention will be apparent to those skilled in the art by a reading of the following description and claims.

The kneader according to the invention is of the type comprising a tank which is provided on the bottom with an impeller and is essentially characterized by the provision of a helix or propeller element being not coupled that is separated from said impeller and apt to feed the worked product to the same impeller.

The invention is schematically illustrated by way of example in the only FIGURE of the accompanying drawing.

With reference to the drawing, the kneader—generally indicated by 1—conventionally comprises a tank 2 provided on the bottom with an impeller 3 surrounded by small blocks 4 intended to cooperate with same impeller 3 in order to increase the friction and, thereby, the kneading effect of same impeller.

According to the invention, on top of the tank 2 a scaffolding or bridge-like structure 5 is provided for supporting a helix or propeller element 6 axially disposed relative to the impeller 3 and pendulum-like connected to a reduction unit 7 which receives driving motion from a motor 8 through a belt drive 9. The impeller 3 is caused to rotate by a separate motor (not illustrated) acting, through a belt 10, upon a pulley 11 on the shaft 12 to which said impeller is keyed.

The pendular movement of the propeller element 6 has the dual function to allow the admission of large size bales of pressed material into the tank and also to follow a revolution movement which permits the gradual crumbling of the material which is still present, in pressed condition in the tank, particularly at the dead zones of said tank.

A structure according to the invention permits to constantly feed the impeller 3 and utilize at best the power delivered by the driving motor of same impeller.

I claim:

1. A kneading device comprising in combination a stationary container, a bridge-like structure positioned over the top of said container, a drive mechanism, a joint means connected to the drive mechanism, a worm member with an axial shaft suspended at an end of said shaft by said joint means from said drive mechanism, said drive mechanism being mounted on said bridge-like structure and positioned substantially centrally above said container suspending said worm member dependently into said container and free for pendular motion; said drive mechanism being constructed to impart rotation to said worm member about the longitudinal axis of the latter, a rotary centrifugal impeller mounted at the bottom of said container, a driving mechanism coupled to said impeller for imparting rotary motion to said impeller, said container and bridge-like structure being oriented such that said worm member extends down from said joint means to a point closely spaced above said impeller, and motor means coupled to said drive mechanism for rotating said worm member in a direction to impart downward movement to any material engaged by said worm member thereby feeding said material toward said impeller, the arrangement enabling said worm member to swing about the joint means thereby permitting the unimpeded addition of bulk material to said container while being free to return to said vertical axis and to encounter any clumped material for effective fragmentation of the latter while downwardly moving said material toward said impeller, said shaft of said worm member at its end remote from said joint means being tapered toward a cone tip with said worm member thereabout decreasing in diameter in the axial direction toward said tip.

2. A kneading device according to claim 1, wherein said driving mechanism for said impeller, and said drive mechanism for said worm member are constructed to drive said impeller at a faster speed than said worm member.

* * * * *